United States Patent [19]

Trost

[11] 4,140,156

[45] Feb. 20, 1979

[54] WEFT STRAND POSITIONING AT THE EXIT END OF THE SHED IN A WEAVING MACHINE

[75] Inventor: Wayne C. Trost, Rockford, Ill.

[73] Assignee: Barber-Colman Company, Rockford, Ill.

[21] Appl. No.: 822,128

[22] Filed: Aug. 5, 1977

Related U.S. Application Data

[63] Continuation-in-part of Ser. No. 730,230, Oct. 6, 1976, abandoned.

[51] Int. Cl.[2] ..... D03D 41/00

[52] U.S. Cl. ..... 139/194; 139/DIG. 1

[58] Field of Search ..... 139/11, DIG. 1, 191, 139/194, 195, 437

[56] References Cited

U.S. PATENT DOCUMENTS

| | | | |
|---|---|---|---|
| 982,862 | 1/1911 | Peterson | 139/191 |
| 2,519,274 | 8/1950 | Moessinger | 139/194 |
| 2,882,932 | 4/1959 | Purdy | 139/195 |
| 3,017,904 | 1/1962 | Mackay | 139/191 |
| 3,665,976 | 5/1972 | Freihofer | 139/437 |
| 3,799,209 | 3/1974 | Dow et al. | 139/DIG. 1 |

*Primary Examiner*—Henry Jaudon
*Attorney, Agent, or Firm*—A. Richard Koch

[57] ABSTRACT

In a triaxial weaving machine, a finger engages the weft as it leaves the shed and moves the weft toward the fell to assure that the dents of two reeds, alternately insertable across the shed, will penetrate the shed above the newly inserted weft.

13 Claims, 5 Drawing Figures

SHEDDING MEANS
SHEDDING MEANS
POSITIONING MEANS
BEATING MEANS
BEATING MEANS
2
2
13
11
14
16
16
15
15
17
18
40
41
32
28
22
40
30
33
29
26
25
31

SHIFTING MEANS
SHIFTINS MEANS
INSERTING MEANS
1
1
10
23
12
15
16
36
37
40
24
21
32
20
22
33
40
25
26

40
49
41
50
52
51
42
48
47
43
44
45
46

WEFT STRAND POSITIONING AT THE EXIT END OF THE SHED IN A WEAVING MACHINE

This is a continuation - in part of application Ser. No. 730,230 filed Oct. 6, 1976, now abandoned.

BACKGROUND OF THE INVENTION

This invention pertains to weaving methods and to weaving machines and particularly to weft strand positioning.

In triaxial weaving machines warp strands are arranged in two sheets which are formed into sheds for receiving weft strands. The warp strands in the sheets are moved weftwise in opposite directions after each shedding operation, as described in the commonly owned Kulczycki U.S. Pat. No. 3,999,578. After insertion into the shed, the weft strand is beaten down against the fell by a reed having dents thereon extending between the warp strands in each sheet. Because of the changing positions of the warp strands in the two sheets, the dents must be withdrawn from the sheets after each pick. It has been found that weft strands inserted into the shed by a gripper type insertion mechanism tend to rise and flutter as the gripper approaches the exit end of the shed. This action is due principally to momentum acquired while travelling in the shed. As a result, the dents penetrating the shed are sometimes below at least a portion of the length of weft strand, so that such a portion is not beaten down against the fell and results in an imperfection in the fabric being woven. Such imperfections may be present in any fabric made on other weaving machines in which the dents of the reed are withdrawn from the shed between picks.

SUMMARY OF THE INVENTION

The exit end of a weft strand newly inserted into the shed is located to eliminate slack from the strand and thus to reduce or compensate for the tendency of the strand to rise and flutter. The strand is moved downward so that all portions thereof are below the dents penetrating the shed. Thus, a novel solution to the aforementioned problem is provided by the invention.

DESCRIPTION OF THE PREFERRED EMBODIMENT

Figure 1:
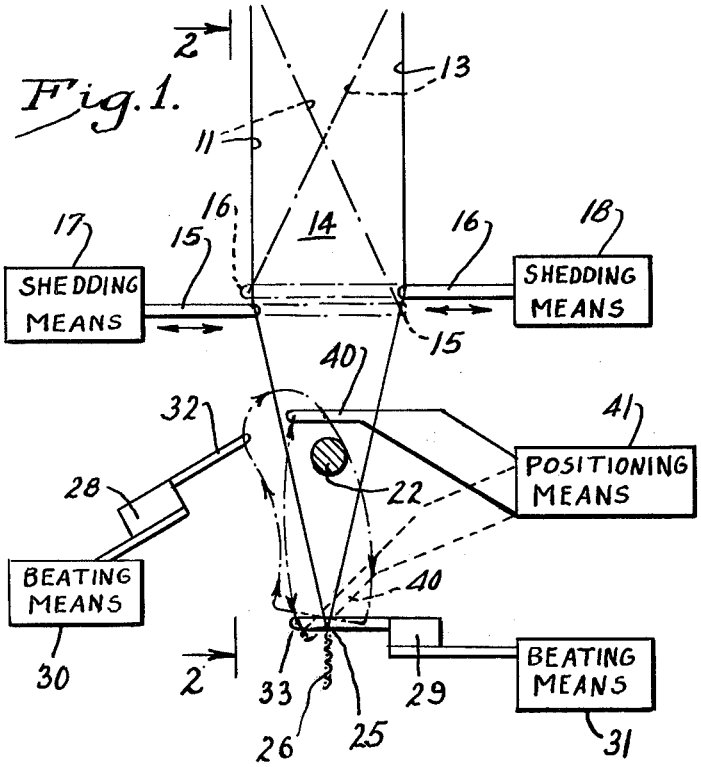
FIG. 1 is a fragmentary end view, partially in section along the line 1—1.
Figure 2:
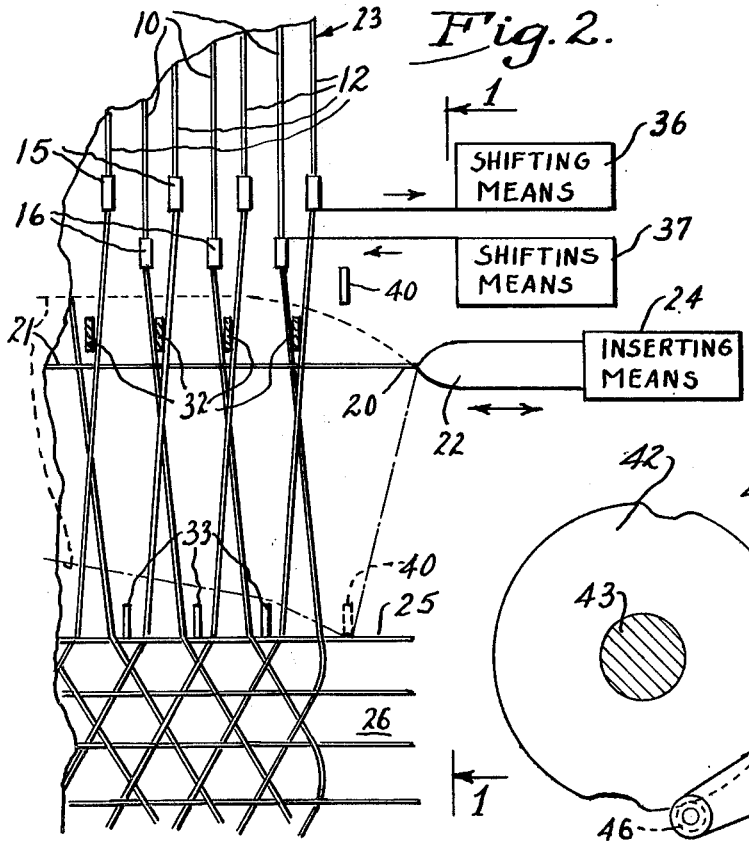
FIG. 2 is a fragmentary elevational view, partially in section along the line 2—2.

As shown in FIGS. 1 and 2, alternate wrap strands 10 are arranged in a sheet 11, while the remaining warp strands 12 are arranged in another sheet 13. A warp shed 14 is formed from the sheets 11, 13 by means of rows of heddles 15, 16 movable between alternate opposed retracted and extended positions under control of shedding means 17, 18. The locations of the sheets and heddles in heddle retracted positions are shown by solid lines and in extended positions by dashed lines. An end 20 of a weft strand 21 is introduced into the entrance end 70 of shed 14 by an entry rapier 71, transferred while in the shed to an exit rapier 22, which draws the end out of the exit end 23 of the shed, under control of weft inserting means 24. The inserted weft strand is beaten down against the fell 25 of the triaxially woven fabric 26 by one of two alternately operable reeds 28, 29 under the control of beating means 30, 31, respectively. Dents 32, 33 on reeds 28, 29, respectively, enter the shed 14 between adjacent warp strands in the near sheet, cross the shed and penetrate between adjacent warp strands in the far sheet, moving in a somewhat ovate path shown for dents 32 as a dash-dotted line in FIG. 1. While moving downward, the dents engage the newly inserted weft strand 21 and beat it down against the fell 25, where it is held substantially until the other of the reeds beats down the next inserted weft strand in the succeeding pick.

In order to weave triaxial fabric 26 the wrap strands 10, 12 forming sheets 11, 13 must be shifted weftwise in opposite directions between picks. This is accomplished by moving the heddles 15, 16 weftwise under control of shifting means 36, 37, respectively. As seen in FIG. 2, warp strands 10 are shifted progressively to the right by heddles 15, while warp strands 12 are shifted progressively to the left by heddles 16, after each pick. As a result of this weftwise shifting, the warp strands 10 cross over the warp strands 12 between the heddles 15, 16 and the fell 25. This makes necessary withdrawal of the dents 32, 33 from the shed 14 between picks.

Figure 4:
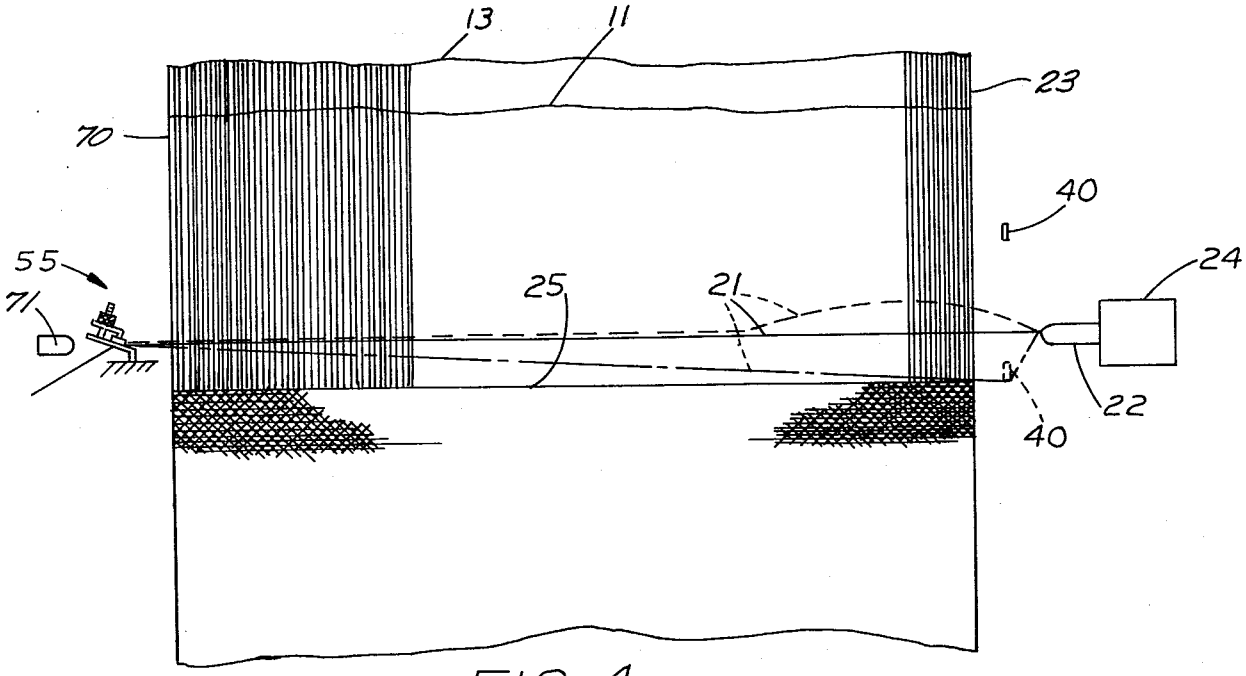
FIG. 4 is a front elevational view of a portion of a triaxial weaving machine.

The tendency of the weft strand 21 to rise and flutter, as indicated by dahsed lines in FIGS. 2 and 4, when the end 20 is withdrawn from the shed 14 makes it possible for the dents 32, 33 to enter the shed below at least a portion of the weft strand. The rising and fluttering typically occurs near the exit side and is due to slack introduced into the inserted weft strand as a result of momentum acquired during its insertion into and withdrawal from the shed. In order to prevent this situation from arising, a positioning finger 40 is located closely adjacent the exit end 23 of the shed 14 and normally above the path of the rapier 22, but movable by positioning means 41 to engage weft strand 21 adjacent the end 20 as the end emerges from the shed and move it downward to the vicinity of the fell 25, as indicated by dashed lines for the finger and dotted lines for the weft strand, thereby applying tension to the weft strand and removing slack therefrom.

Figure 3:
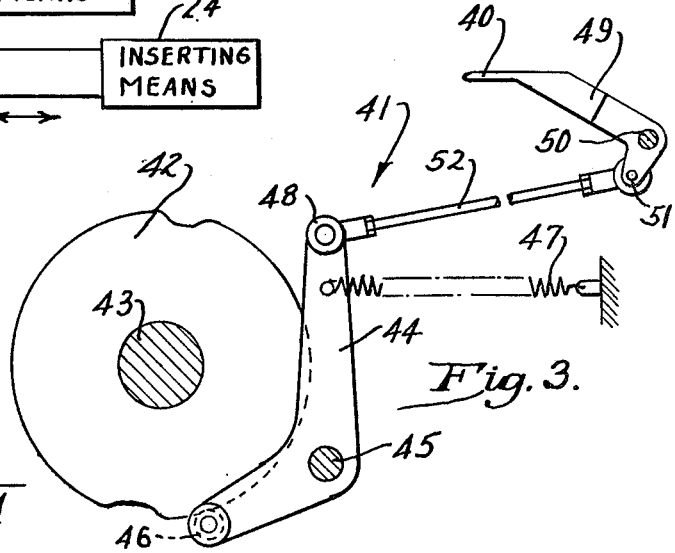
FIG. 3 is an elevational view of the weft positioning apparatus at the exit end of the wrap shed.

As shown in FIG. 3, the positioning means 41 for the finger 40 comprises a cam 42 mounted on a drive shaft 43 controlling timed operations of operable members of a weaving machine. The finger and cam are connected by means of a linkage comprising a bellcrank lever 44, movable about a fixed pivot 45 and having on one end a roller follower 46 engaging the cam 42. The tension spring 47 exerts a pull on the other driving end 48 to bias the roller against the cam surface. The finger 40 forms a free end of a second bellcrank lever 49, pivoted about a fixed fulcrum 50, and having a driven end 51. A link 52 interconnects the driving end 48 and driven end 51.

In order to insure that the slack in the inserted weft strand 21 is removed by the action of positioning finger 40 it is necessary to provide means for restraining the weft strand near the entry side of the shed, at least during the time that positioning finger 40 operates to displace weft strand 21. The restraining means need not prevent all movement of the weft strand. It need only inhibit weft strand travel to the extent necessary to provide sufficient tension in the weft strand to permit removal of slack by the action of positioning finger 40. This may be accomplished by providing any of a number of various types of tension devices. FIG. 4 shows a typical tension device, generally indicated at 55, suitably positioned with respect to the shed. Tension device 55 may be supported on the machine itself or it may be independently supported on a suitable strand adjacent the machine. The weft yarn is fed from a yarn package (not shown) through tension device 55 and in inserted in the shed by the weft inserting mechanism as previously described.

Figure 5:
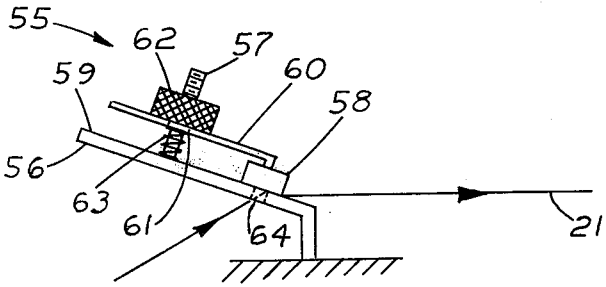
FIG. 5 is a detailed view a tension device employed in the preferred embodiment.

Tension device 55 is shown in more detail in FIG. 5. As shown tension device 55 has a base bracket 56, a threaded post 57 fixed substantially perpendicular to bracket 56, and pressure pad 58 adjacent to top surface 59 of brackets 56. Pressure pad arm 60, which is disposed substantially parallel to surface 59, is connected at one end to pad 58 and is located over post 57 by means of hole 61 displaced a suitable distance from pad 58. Knurled nut 62 urges arm 60 against spring 63 and thereby forces pad 58 against surface 59. Weft strand 21 is fed through hole 64 in bracket 56 and between pad 58 and surface 59. The tension on weft strand 21 can be increased or decreased through the adjustment of nut 63. It will, of course, be appreciated that numerous types of tension devices exist and would be suitable for the purpose described.

With the shed 14 open and the heddles 15, 16 in retracted solid line positions, the end 20 of weft strand 21 in inserted into the shed, and is withdrawn by exit rapier 22 under control of inserting means 24. As the end 20 emerges from the shed and while the end is still gripped in the exit rapier (as shown in FIG. 4), finger 40, controlled by positioning means 41, descends from its normal position to engage the weft strand 21 closely adjacent to the exit end 23 of the shed and displace it downward, so that the dents 32, under control of beating means 30, entering between the warp strands 10 in warp sheet 11 will cross the shed 14 above the weft strand 21 and penetrate between warp strands 12 in warp sheet 13 as they beat down the weft strand against the fell 25. The dents 33 are withdrawn from the position shown in FIG. 1 by beating means 31 after the dents 32 have penetrated between the warp strands in each sheet, and preferably shortly before the inserted weft strand 21 is beaten down against the fell, to prevent loosening of the woven fabric and to prevent the crossing of the warp strands 10, 12 from moving upward into a position such that warp strands 10, 12 could interfere with dents 32 entering therebetween and making possible the improper entry of two wrap strands 10 or 12 between adjacent dents 32 and of no warp strands 10 or 12 between other adjacent dents 32. Any such condition would result in a defect in the fabric 26. The weft strand 21 is maintained in tension as a result of retention by the exit rapier 22 until after the beating down of the weft strand has begun, and preferrably until the dents 32 are near the fell, at which time the rapier releases the weft end 20. As a result of this tension on the weft strand, substantially the entire weft strand is displaced toward the fell as the portion of weft strand adjacent end 20 is displaced by the finger 40. The shifting means 36 moves heddles 15 and their associated warp strands 10 weftwise to the right, as seen in FIG. 2, while shifting means 37 moves heddles 16 and their associated warp strands 11 weftwise to the left. Shedding means 17, 18 then move heddles 15, 16 to their extended dashed line positions, thus forming a new shed 14. At some time before the exit rapier 22 next enters the shed to withdraw another end 20, the finger 40 is raised by positioning means 41 to its normal position above the path of the rapier.

On the next pick another end 20 is introduced into the new shed 14, indicated by dashed lines, by an entry rapier and withdrawn therefrom by the exit rapier 22. As the end emerges from the shed, finger 40 descends, engaging the new weft strand 21 and displacing it downward so that dents 33, entering between warp strands 10 in sheet 11, will cross the new shed above the weft strand and beat it down against the fell 25, the dents 32 being withdrawn shortly before the new weft strand is beaten down against the fell. While the reed 29 is beating down the weft strand, the end 20 is released by rapier 22. The shifting means 36, 37, again move heddles 15, 16 weftwise to the right and left respectively, as seen in FIG. 2. Shedding means 17, 18 move heddles 15, 16 back to their restracted solid line positions to form another open shed 14. At some time before the exit rapier 22 next enters the shed, the finger 40 is raised to its normal position above the path of rapier 22. The machine is then ready to repeat the cycle.

It will be obvious that any gripper type insertion mechanism could be substituted for the rapiers and that the invention is applicable to other weaving machines in which dents are withdrawn from the shed while the weft strand is being inserted, whether or not weftwise shifting of the warp strands is involved. A gripper type inserting mechanism firmly grips an end of a weft strand and carries the end through the shed, drawing the warp strand behind it.

The described embodiment is exemplary only. It will be recognized by those skilled in the art that many equivalent means as available. For example, a second finger similar to finger 40 could be employed at the entry side of the shed, instead of or in addition to the tension device shown, to accomplish removal of the slack. Some of the operations and components described herein are not required in other weaving machines to which this invention is applicable. The scope of the invention is defined by the claims.

I claim:

1. A method for reducing rise and flutter of a weft strand newly inserted into a shed by a gripper type inserting mechanism while weaving a fabric, said method comprising the steps of arranging a plurality of warp strands into two sheets, forming the sheets into a shed, introducing an end of a weft strand into an entrance end of the shed, withdrawing said weft end by the gripper type inserting mechanism from an exit end of the shed, and characterized by displacing the weft strand adjacent the exit end toward the fell of said fabric as the weft end emerges from said shed while both gripping said weft end in said inserting mechanism and constraining movement of said weft strand proximate to said entrance end to apply tension to the inserted weft strand and thereby remove slack therefrom, and beating down the weft strand against said fell.

2. A method according to claim 1 further comprising inserting a reed across the shed above said weft strand and such that dents on said reed enter between respective warp strands in each of said sheets from one side of the sheets before said beating down of the weft strand therewith, and withdrawing said reed from the shed and the dents on said reed from between the warp strands after said beating down of the weft strand.

3. A method according to claim 2 further comprising forming a subsequent shed from said sheets, introducing an end of another weft strand into an entrance end of the subsequent shed, withdrawing said end of another weft strand from an exit end of the subsequent shed, displacing toward said fell the other weft strand adjacent said end of another weft strand as it emerges from the subsequent shed, inserting a second reed across the subsequent shed above said other weft strand and such that dents on said second reed enter between respective warp strands in each of said sheets from the other side of the sheets, employing said second reed to beat down the other weft strand against said fell, and withdrawing said second reed from the subsequent shed and the dents on said second reed from between the respective warp strands.

4. A method according to claim 3 further comprising timing withdrawal of the first reed to occur after the second reed has been inserted between the warp strands in each of said sheets.

5. A method according to claim 4 further comprising shifting the warp strands in one of said sheets weftwise in one direction, and shifting the warp strands in the other of said sheets weftwise in the opposite direction, said shifting steps occurring between the shed forming steps.

6. A triaxial weaving machine comprising means for arranging a plurality of warp strands into two sheets, means for moving said sheets weftwise in opposite directions, means for forming said sheets into a shed, means for inserting an end of a weft strand into the shed from an entrance end and for withdrawing said weft end from an exit end of the shed, a reed having dents entering and exiting the shed for beating down said weft strand against the fell of a fabric being woven, means proximate said entrance end for constraining longitudinal movement of the weft strand, and characterized by a member located adjacent said exit end and movable from a normal position out of the path of said inserting and withdrawing means to engage and displace said weft strand adjacent the exit end toward the fell.

7. A weaving machine according to claim 6 further comprising positioning means for moving said member such that the member displaces said weft strand toward the fell before said weft strand is beaten down.

8. A weaving machine according to claim 7 wherein said positioning means moves the member to engage said weft strand substantially immediately after the end of said weft strand is withdrawn from the shed.

9. A weaving machine according to claim 7 wherein said means for inserting and withdrawing maintains tension on the weft strand during displacement pf said weft strand by said member.

10. A weaving machine according to claim 6 wherein said member comprises a finger.

11. A weaving machine according to claim 10 further comprising a fixed flucrum for said finger, and positioning means for moving the finger about said fulcrum such that the finger displaces said weft strand toward the fell before said weft strand is beaten down.

12. A weaving machine according to claim 6 further comprising positioning means for moving said member such that the member engages and moves said weft strand into a position adjacent the fell before said weft strand is released from the means for inserting and withdrawing.

13. A weaving machine according to claim 6 further comprising positioning means for moving said member such that the member engages and moves said weft strand toward the fell before the dents on said reed enter the shed.

* * * * *